US007472775B2

(12) United States Patent
Tuten

(10) Patent No.: US 7,472,775 B2
(45) Date of Patent: Jan. 6, 2009

(54) TRUCK MOUNTED BRAKE ASSEMBLY

(75) Inventor: Travis C Tuten, Moore, SC (US)

(73) Assignee: TNC Rail, LLC, Moore, SC (US)

( * ) Notice: Subject to any disclaimer, the term of this patent is extended or adjusted under 35 U.S.C. 154(b) by 147 days.

(21) Appl. No.: 11/443,527

(22) Filed: May 30, 2006

(65) Prior Publication Data

US 2007/0209886 A1 Sep. 13, 2007

Related U.S. Application Data

(60) Provisional application No. 60/779,774, filed on Mar. 7, 2006.

(51) Int. Cl.
*B61H 13/02* (2006.01)

(52) U.S. Cl. ..... 188/52; 188/219.1

(58) Field of Classification Search ..... 188/52, 188/196 R, 196 V, 197, 202, 203, 219.1
See application file for complete search history.

(56) References Cited

U.S. PATENT DOCUMENTS

| | | | | |
|---|---|---|---|---|
| 2,958,398 | A | 11/1960 | Newell | |
| 3,101,814 | A | 8/1963 | Newell | |
| 3,499,507 | A | 3/1970 | Scott | |
| 4,793,446 | A | 12/1988 | Hart | |
| 5,259,485 | A | 11/1993 | Jackson | |
| 5,361,876 | A | 11/1994 | Haverick | |
| 5,400,874 | A | 3/1995 | Gayfer | |
| 5,495,921 | A | 3/1996 | Samulak | |
| 5,785,159 | A * | 7/1998 | Jackson et al. | 188/219.1 |
| 6,112,860 | A | 9/2000 | Shepherd | |
| 6,443,270 | B1 | 9/2002 | Hodge | |

* cited by examiner

*Primary Examiner*—Christopher P Schwartz
(74) *Attorney, Agent, or Firm*—Spilman Thomas & Battle PLLC

(57) ABSTRACT

A truck mounted brake assembly wherein a brake cylinder assembly and slack adjuster each have a first end connected to a first brake beam, and a second end coupled to each other via a first lever pivotally attached to a second brake beam, such that movement of the brake beams relative to each other applies and releases the brakes. The slack adjuster can have a trigger operating slack adjustment, and a rod member can have one end connected to the first brake beam and an opposite end coupled to the trigger via a second lever pivotally attached to the second brake beam, such that movement of the brake beams relative to each other causes the rod member to operate the trigger. The trigger can be connected to the second lever in a length adjustable manner, and a piston travel indicator can be provided adjacent the brake cylinder assembly.

28 Claims, 4 Drawing Sheets

TRUCK MOUNTED BRAKE ASSEMBLY

RELATED APPLICATIONS

This application claims priority to U.S. Provisional Patent Application Ser. No. 60/779,774, filed Mar. 7, 2006.

BACKGROUND

The truck mounted brake assembly described herein relates to such an assembly having a single brake cylinder and a separate slack adjuster each mounted between opposing truss type brake beams of a conventional truck mounted brake rigging which applies brake shoe members to the wheels of the rail vehicle.

Truck mounted brake assemblies are well known in the art. For example, U.S. Pat. Nos. 2,958,398, 3,101,814, 3,499,507, and 4,793,446 describe truck mounted brake systems. The first three patents appear to describe dual brake cylinder systems, the latter two of those three apparently incorporate a slack adjustment member in combination with the two brake cylinders. The fourth listed patent appears to describe to a single brake cylinder system with a separate slack adjuster member occupying the general location of one of the previously employed two brake cylinders shown in the prior three patents. This patent, U.S. Pat. No. 4,793,446, further describes another prior art single-cylinder truck mounted brake assembly "shown in U.S. Pat. No. 4,613,016 and comprises, in addition to the brake beams, a force-transfer lever that is pivotally-connected to each brake beam at its midpoint, with the corresponding lever arms of these force-transfer levers being connected to the force-transmitting members. One force-transmitting member comprises a slack adjuster device, such as that disclosed in copending U.S. application Ser. No. 06/714,596. The other force-transmitting member includes a brake cylinder device, the body of which is mounted on one brake beam between the beam tension and compression members adjacent the strut bar, and a connecting rod between the transfer lever arm of the other brake beam and the cylinder body. The brake cylinder piston push rod is connected to the transfer lever arm of the one brake beam." Slack adjusters are used to take up the rigging slack caused by brake shoe and wheel wear to ensure that the brake cylinder power stroke remains essentially the same length for each operation of the rail vehicle brake system.

Notwithstanding the availability of single cylinder brake assemblies for many years, there are still many older rail vehicles which are equipped with the earlier designed dual brake cylinder truck mounted brake assemblies of the type described above. As a practical manner, usually due to the cost factor, many older rail vehicles are not "upgraded" until it becomes necessary to do so.

In addition to providing single cylinder truck mounted brake assembly for new rail vehicles, it is also desirable to provide for converting existing rail vehicles from the older style dual cylinder brake assemblies to a new a single cylinder brake assembly, such as will be described in more detail below.

SUMMARY

A truck mounted brake assembly as described herein can generally comprise a single brake cylinder assembly and a slack adjuster operatively connected between a pair of opposing brake beams in a brake rigging arrangement for applying brake shoes to the wheels of the truck. The brake cylinder assembly typically includes a piston and associated push rod, and the slack adjuster can have a "trigger" which controls the slack adjusting function. The brake cylinder and a first end of the slack adjuster can each be connected to a first brake beam, whereas the push rod and a second end of the slack adjuster can be coupled to each other at the second brake beam by a live lever which is pivotally connected to the second brake beam. Additionally, a rod member can have one end connected to the first brake beam and a second end coupled to the trigger on the slack adjuster by a second "actuating" lever which can be pivotally connected to the second brake beam. In this manner, as the first and second brake beams move relative to each other to apply and release the brakes, the rod member operates the trigger on the slack adjuster via the actuating lever to perform the slack adjusting function.

More particularly, a truck mounted brake assembly as described herein can comprise:

a brake cylinder assembly having one end connected to the first brake beam and a push rod member coupled to the second brake beam, such that pressurization of the brake cylinder extends the push rod causing the first and second brake beams to move apart;

a slack adjuster having a slack adjustment trigger, the slack adjuster having a first end connected to the first brake beam and a second end coupled to the second brake beam;

a live lever pivotally attached to the second brake beam, the live lever having a first arm connected to the push rod and a second arm connected to the second end of the slack adjuster;

a rod member having a first end attached to the first brake beam and a second end coupled to the second brake beam; and an actuating lever pivotally attached to the second brake beam, the actuating lever having a first arm connected to the second end of the rod member and a second arm connected to the slack adjustment trigger, such that the rod member moves the actuating lever to operate the trigger to adjust slack as the first and second brake beams move relative to each other.

The actuating lever and/or the live lever can have a centered pivot point, such that the lever arms are the same length. Alternative, either or both may have an offset pivot point, such that the lever arms would be different lengths. Other aspects can include a link member having a first end connected to the trigger and a second end connected to the second arm of the actuating lever, and the link member can be an adjustable length link member. Additionally, a piston travel indicator can be provided adjacent the brake cylinder, or more specifically, the piston.

As further described herein, a method of adjusting slack in a truck brake rigging having first and second brake beams connected to brake shoes held adjacent to wheels of the truck can comprise:

between the first and second brake beams, coupling a brake cylinder assembly with a slack adjuster using a first lever, such that pressurization of the brake cylinder causes the first and second brake beams to move apart; and between the first and second brake beams, coupling a rod member with a slack adjustment trigger on the slack adjuster using a second lever, in a manner such that movement of the first and second brake beams relative to each other operates the trigger to adjust slack;

The method can further comprise connecting the trigger to the second lever in a length adjustable manner, and measuring piston travel and providing an indication thereof adjacent to the piston.

Additional objects and advantages will become apparent in light of the attached drawing sheets and following detailed description of the truck mounted brake assembly.

BRIEF DESCRIPTION OF THE DRAWING FIGURES

A more complete understanding of the truck mounted brake assembly described herein can be obtained by considering the following description in conjunction with the accompanying drawings, in which.

Figure 1:
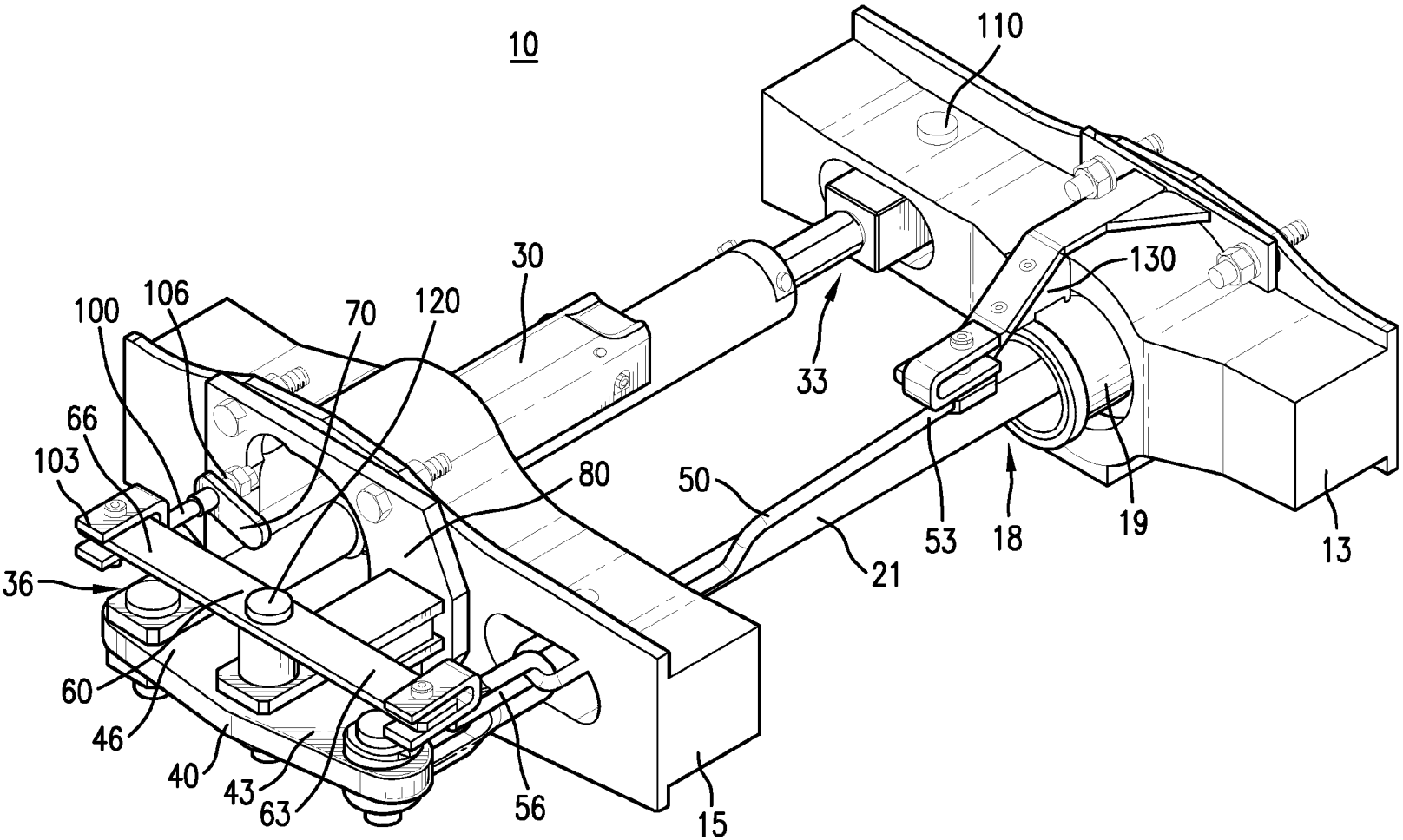
FIG. 1 is a perspective view of an embodiment of a truck mounted brake assembly as described herein.
Figure 4:
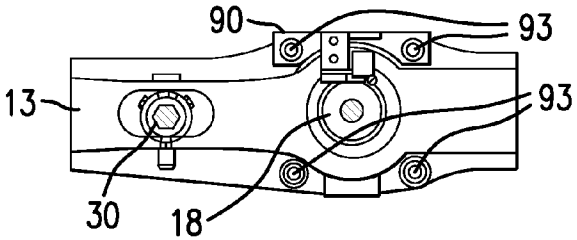
Figure 5:
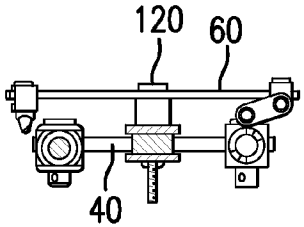
Figure 6:
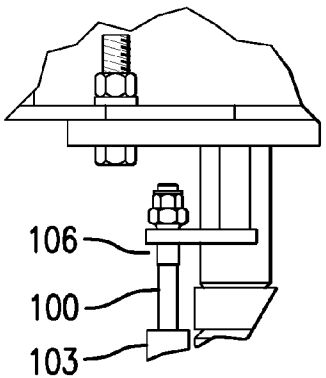
Figure 3:
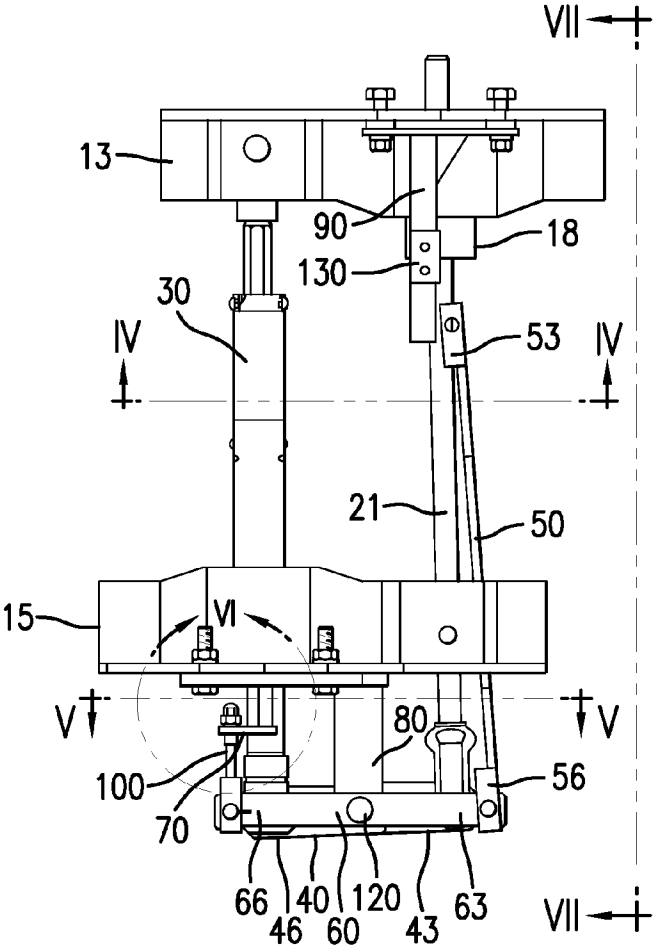

FIG. 3 top view of the embodiment shown in FIG. 1;

FIG. 4 is a view taken along line IV-IV in FIG. 3;

FIG. 5 is a view taken along line V-V in FIG. 3;

FIG. 6 is a view of section VI in FIG. 3; and

Figure 7:
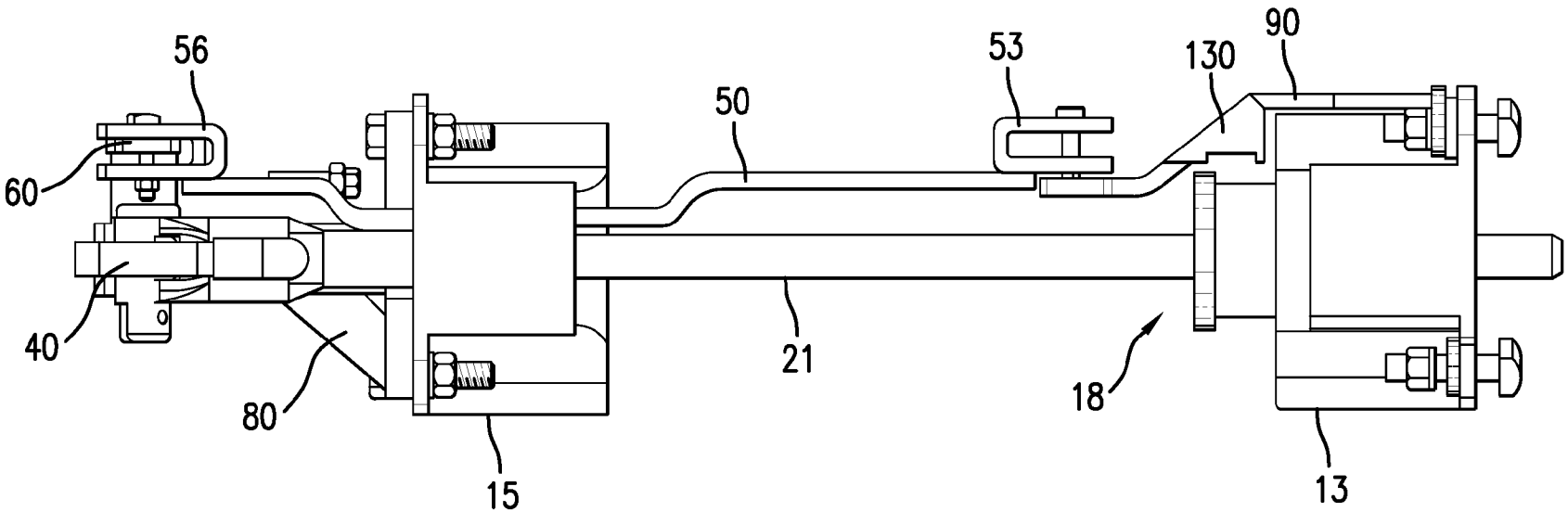

FIG. 7 is a view taken along line VII-VII in FIG. 3.

DESCRIPTION OF CERTAIN EMBODIMENTS

Referring now to the drawing figures, wherein like reference numbers refer to like components, there is shown in FIG. 1 a perspective view of an embodiment of a truck mounted brake assembly 10 on a truck having first 13 and second 15 brake beams connected to brake shoes (not shown) held adjacent to wheels of the truck such that movement of the first 13 and second 15 brake beams relative to each other results in application and release of the brake shoes. In the embodiment illustrated, the truck mounted brake assembly 10 can comprise:

a brake cylinder assembly 18 having one end connected to the first brake beam 13 and a push rod member 21 coupled to the second brake beam 15, such that pressurization of the brake cylinder extends the push rod 21 causing the first 13 and second 15 brake beams to move apart;

a slack adjuster 30 having a slack adjustment trigger, the slack adjuster having a first end 33 connected to the first brake beam 13 and a second end 36 coupled to the second brake beam 15;

a live lever 40 pivotally attached to the second brake beam 15, the live lever 40 having a first arm 43 connected to the push rod 21 and a second arm 46 connected to the second end 36 of the slack adjuster;

a rod member 50 having a first end 53 attached to the first brake beam 13 and a second end 56 coupled to the second brake beam 15; and an actuating lever 60 pivotally attached to the second brake beam 15, the actuating lever 60 having a first arm 63 connected to the second end 56 of the rod member 50 and a second arm 66 connected to the slack adjustment trigger 70, such that the rod member 50 moves the actuating lever 60 to operate the trigger 70 to adjust slack as the first 13 and second 15 brake beams move relative to each other.

Referring to FIGS. 2 through 6, it can be better observed that the truck mounted brake assembly 10 can have a first bracket 80 connectable to the second brake beam 15, and the live lever 40 and actuating lever 60 can each be pivotally attached to the first bracket 80. The first bracket 80 can be connectable to the second brake beam 15 using existing mounting holes 83 on the second brake beam 15 to which a brake cylinder assembly was previously connected. In this way, the first bracket 80 facilitates replacing one of a pair of brake cylinder assemblies previously utilized on the truck with the brake assembly 10 using existing mounting holes 83.

As also shown in FIGS. 3 and 4, a second bracket 90 can be provided which is connectable to the first brake beam 13, and wherein the associated end 53 of the rod member 50 is connected to the second bracket 90. Similarly to the first bracket 80, the second bracket 90 can be connectable to the first brake beam 13 using existing mounting holes 93, such as, for example, two of the same mounting holes 93 to which the brake cylinder assembly 18 is mounted. In this way, the second bracket 90 likewise facilitates connecting the new truck mounted brake cylinder assembly 10 using existing mounting holes on the brake beams.

Referring also to FIGS. 3 and 6, it can be seen that a link member 100, which can be length adjustable, can have a first end 103 connected to the trigger 70 and a second end 106 connected to the second arm 66 of the actuating lever 60. As described, and shown, the rod member 50 is connected to the first end 63 of the actuating lever 60, and the trigger 70 is thus operated via the actuating lever 60 and the link member 100 as the brake beams 13, 15 move relative to each other. Additionally, the link member 100 can be an adjustable length link.

Figure 2:
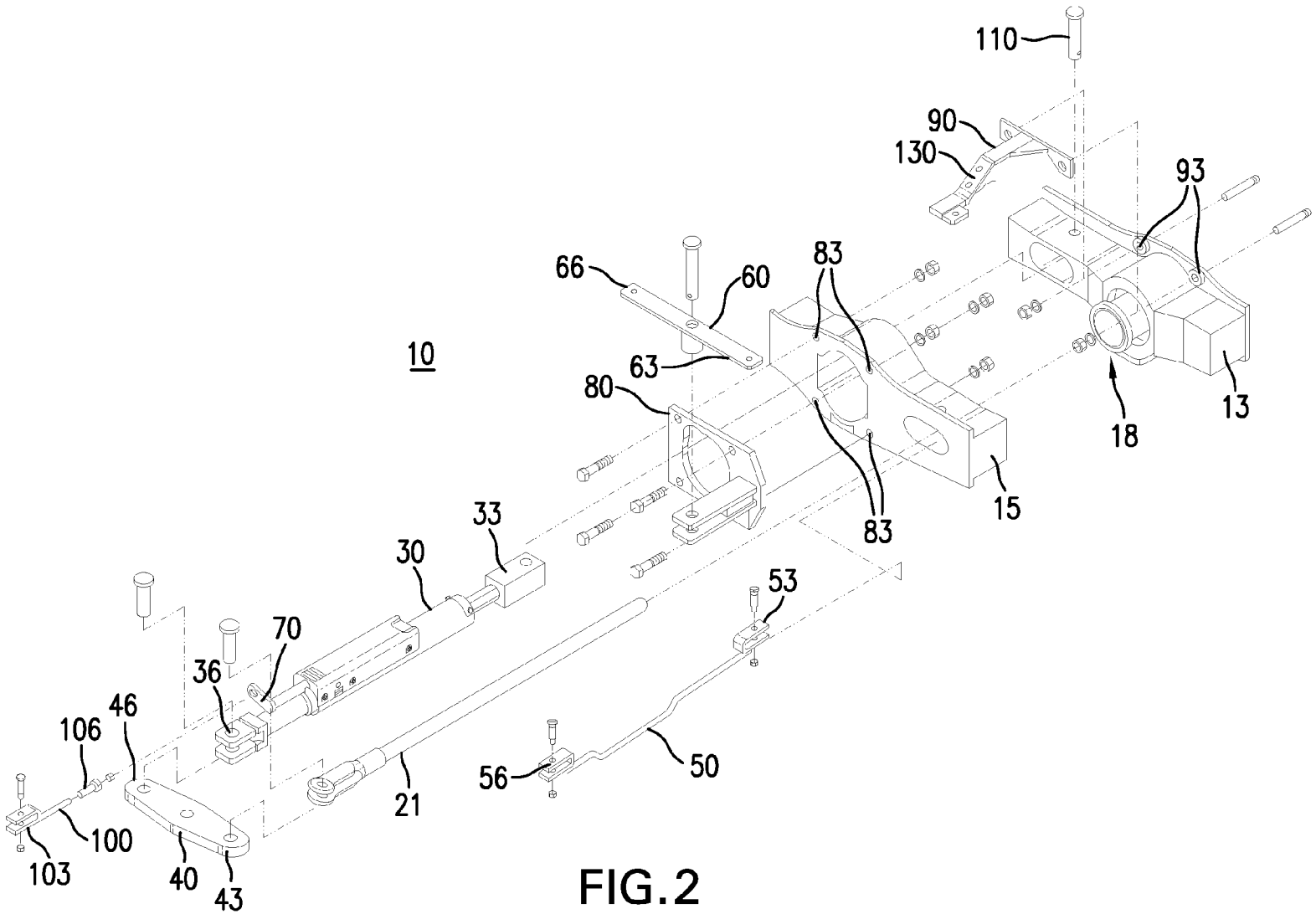
FIG. 2 is an exploded view of the embodiment shown in FIG. 1.

As perhaps best viewed in FIG. 2, the brake cylinder assembly 10 can be bolted to the first brake beam 13 via the four mounting holes 93, and the associated end 33 of the slack adjuster 30 can be connected to the first brake beam by a pin 110. The opposite end 36 of the slack adjuster 30 can be pinned to one arm 46 of the live lever 40 and the push rod member 21 of the brake cylinder assembly 18 can be pinned to the opposite arm 43 of the live lever 40. Referring additionally to FIGS. 3 and 5, both the live lever 40 and the actuating lever 60 can be pivotally attached to the first bracket 80, which can be bolted to the second brake beam 15 using, for example, four bolts and the existing four mounting holes 83 in the brake beam 15 to which a brake cylinder assembly was, or could have been, mounted.

Referring also to FIGS. 3 and 4, one end 53 of the rod member 50 can be pinned to the second bracket 90, which can be bolted to the first brake beam 13, for example using two bolts and two of the existing four mounting holes 93 in the first brake beam 13 by which the brake cylinder assembly 18 can also be bolted. The opposite end 56 of the rod member 50 can be pinned to one arm 63 of the actuating lever 60. The link member 100 can have one end 103 pinned to the opposite arm of the actuating lever 60 and an opposite end 106 connected to the trigger 70. The link 100 can also be any suitable type of length adjustable member.

As shown best in FIGS. 3 and 5, both the live lever 40 and the actuating lever 60 are illustrated as having a centered pivot point 120, such that the first and second arms of both levers are of equal length. However, either the actuating lever 60 or the live lever 40 could alternatively have an offset pivot point (not shown), such that the first and second lever arms could be of different lengths. As shown in the drawing figures, the live lever 40 is connected between the brake cylinder push rod 21 and the second end 36 of the slack adjuster 30 in a manner that can be similar to that shown in the prior art. The actuating lever 60, however, is connected between only the fixed rod 50 and the trigger 70, which is a part of the slack adjuster 30 which activates the slack adjusting function. In this arrangement, the brake cylinder push rod 21 is not connected to the actuating lever 60, but is connected only to the separate live lever 40. As shown in the drawings, the actuating lever 60 can be provided on the same brake beam 15 as the live lever 40. However, the brake assembly could be alternatively designed such that the actuating lever 60 could be provided on the opposite brake beam 13, or could be located elsewhere, so long as the actuating lever 60 is associated with the slack adjuster trigger 70 separately from the live lever 40.

Referring now to FIG. 7 in particular, the truck mounted brake assembly 10 can additionally comprise a piston travel indicator 130 which can be provided adjacent the brake cylinder assembly 18, or more specifically, adjacent a piston member 19 thereof. As illustrated, the piston travel indicator 130 can be made integral with, or attached to, the second bracket 90. However, it is to be understood that the piston travel indicator 130 could also be separately attached adjacent to the piston 19, such as to another adjacent portion of the first brake beam 13, or any other adjacent structure.

As can be understood from the preceding description, a method of adjusting slack in a truck mounted brake rigging having first 13 and second 15 brake beams is also enabled. Such a method can comprise, between the first 13 and second 15 brake beams, coupling a brake cylinder assembly 18 with a slack adjuster 30 using a first, live lever 40, in a manner such that pressurization of the brake cylinder causes the first 13 and second 15 brake beams to move apart, and, between the first 13 and second 15 brake beams, additionally coupling a rod member 50 with a slack adjustment trigger 70 on the slack adjuster 30 using a second, actuating lever 60, in a manner such that movement of the first 13 and second 15 brake beams relative to each other operates the trigger 70 to adjust slack. The method additionally contemplates connecting the trigger 70 to the actuating lever 60 in a length adjustable manner and providing an indication of piston travel.

As described above, the truck mounted brake assembly 10 can comprise a single brake cylinder assembly and slack adjuster arrangement, wherein the brake cylinder assembly 18 is mounted in the usual manner between the two truss type brake beams 13, 15, and the slack adjuster 30 is mounted between the brake beams 13, 15 in place of a second brake cylinder assembly. In this manner, one of the two existing brake cylinder assemblies can be left in place, subject to that brake cylinder needing repair, or replacement, and the slack adjuster arrangement would simply replace the second brake cylinder assembly.

Therefore, the truck mounted brake assembly 10 is ideal for updating prior art style dual brake cylinder assemblies which are still in place on many rail vehicle still in use today. As these older vehicles need repair or upgrading of the brake assemblies, it can be advantageous to convert the older dual brake cylinder assemblies with newer single cylinder assemblies, and in particular the single brake cylinder assembly 10 described herein. However, because the single brake cylinder assembly 10 described herein has certain features not associated with conventional single brake cylinder systems, it could also be designed to convert such existing single brake cylinder systems to the present system.

Although certain embodiments of the invention have been described in detail, it will be appreciated by those skilled in the art that various modifications to those details could be developed in light of the overall teaching of the disclosure. Accordingly, the particular embodiments disclosed herein are intended to be illustrative only and not limiting to the scope of the invention.

What is claimed is:

1. A truck mounted brake assembly on a truck having first and second brake beams connected to brake shoes held adjacent to wheels of the truck such that movement of the first and second brake beams relative to each other results in application and release of the brake shoes, the truck mounted brake assembly comprising:

a. a brake cylinder assembly having one end connected to said first brake beam and a push rod member coupled to said second brake beam, such that pressurization of said brake cylinder extends said push rod causing said first and second brake beams to move apart;

b. a slack adjuster having a slack adjustment trigger, said slack adjuster having a first end connected to said first brake beam and a second end coupled to said second brake beam;

c. a live lever pivotally attached to said second brake beam, said live lever having a first arm connected to said push rod and a second arm connected to said second end of said slack adjuster;

d. a rod member having a first end attached to said first brake beam and a second end coupled to said second brake beam; and e. an actuating lever pivotally attached to said second brake beam, said actuating lever having a first arm connected to said second end of said rod member and a second arm connected to said slack adjustment trigger, such that said rod member moves said actuating lever to operate said trigger to adjust slack as said first and second brake beams move relative to each other.

2. The truck mounted brake assembly of claim 1 further comprising a link member having a first end connected to said trigger and a second end connected to said second arm of said actuating lever.

3. The truck mounted brake assembly of claim 2 wherein said link member comprises an adjustable link.

4. The truck mounted brake assembly of claim 1 further comprising a piston travel indicator adjacent said brake cylinder.

5. The truck mounted brake assembly of claim 1 further comprising a first bracket connectable to said second brake beam, and wherein said live lever and said actuating lever are each pivotally attached to said bracket.

6. The truck mounted brake assembly of claim 5 further comprising said first bracket connectable to said first brake beam using existing mounting holes on said first brake beam to which a brake cylinder assembly was previously connected, such that said first bracket facilitates one of a pair of brake cylinder assemblies previously utilized on the truck being removed and replaced with said first bracket and said slack adjuster using existing mounting holes.

7. The truck mounted brake assembly of claim 1 further comprising a second bracket connectable to said first brake beam, and wherein said second end of said rod member is connected to said second bracket.

8. The truck mounted brake assembly of claim 7 further comprising said second bracket connectable to said second brake beam using existing mounting holes on said second brake beam to which said brake cylinder assembly is connected, such that said second bracket facilitates connecting said rod member using existing mounting holes.

9. The truck mounted brake assembly of claim 7 further comprising a piston travel indicator associated with said second bracket.

10. The truck mounted brake assembly of claim 1 further comprising said live lever having a centered pivot point such that said first and second arms of said live lever are of equal length.

11. The truck mounted brake assembly of claim 1 further comprising said live lever having an offset pivot point such that said first and second arms of said live lever are different lengths.

12. The truck mounted brake assembly of claim 1 further comprising said actuating lever having a centered pivot point such that said first and second arms of said actuating lever are of equal length.

13. The truck mounted brake assembly of claim 1 further comprising said actuating lever having an offset pivot point such that said first and second arms of said actuating lever are different lengths.

14. A method of adjusting slack in a truck mounted brake rigging having first and second brake beams connected to brake shoes held adjacent to wheels of the truck such that movement of the first and second brake beams relative to each other results in application and release of the brake shoes, said method comprising:

a. between said first and second brake beams, coupling a brake cylinder assembly with a slack adjuster using a first lever, in a manner such that pressurization of said brake cylinder causes said first and second brake beams to move apart;

b. between said first and second brake beams, coupling a rod member with a slack adjustment trigger on said slack adjuster using a second lever, in a manner such that movement of said first and second brake beams relative to each other operates said trigger to adjust slack.

15. The method of claim 14 further comprising connecting said trigger to said second lever in a length adjustable manner.

16. The method of claim 14 further comprising measuring piston travel of a piston associated with said brake cylinder assembly, and providing an indication thereof adjacent to said piston.

17. A truck mounted brake assembly on a truck having first and second brake beams connected to brake shoes held adjacent to wheels of the truck such that movement of the first and second brake beams relative to each other results in application and release of the brake shoes, the truck mounted brake assembly comprising:

a. a brake cylinder and piston assembly connected to said first brake beam;

b. a push rod having a first end connected to said piston and a second end coupled to said second brake beam, such that pressurization of said brake cylinder extends said piston and said push rod to move said first and second brake beams apart;

c. a slack adjuster having one end connected to said first brake beam and a second end coupled to said second brake beam, said slack adjuster having a trigger controlling slack adjustment;

d. a live lever pivotally connected to said second brake beam, said live lever having a first arm connected to said second end of said push rod and a second arm connected to said second end of said slack adjuster;

e. a rod member having a first end attached to said first brake beam and a second end coupled to said second brake beam;

f. a link member having a first end connected to said trigger on said slack adjuster and a second end coupled to said second brake beam; and g. an actuating lever pivotally attached to said second brake beam, said actuating lever having a first arm connected to said second end of said rod member and a second arm connected to said second end of said link member, wherein said rod member moves said link member to operate said trigger to adjust slack as said first and second brake beams move relative to each other.

18. The truck mounted brake assembly of claim 17 wherein said link member comprises an adjustable length link member.

19. The truck mounted brake assembly of claim 18 further comprising a piston travel indicator adjacent said piston.

20. The truck mounted brake assembly of claim 17 further comprising a first bracket connectable to said second brake beam, and wherein said live lever and said actuating lever are each pivotally attached to said bracket.

21. The truck mounted brake assembly of claim 20 further comprising said first bracket connectable to said first brake beam using existing mounting holes on said first brake beam to which a brake cylinder assembly was previously connected, such that said first bracket facilitates one of a pair of brake cylinder assemblies previously utilized on the truck being removed and replaced with said first bracket and said slack adjuster using existing mounting holes.

22. The truck mounted brake assembly of claim 17 further comprising a second bracket connectable to said first brake beam, and wherein said second end of said rod member is connected to said second bracket.

23. The truck mounted brake assembly of claim 22 further comprising said second bracket connectable to said second brake beam using existing mounting holes on said second brake beam to which said brake cylinder assembly is connected, such that said second bracket facilitates connecting said rod member using existing mounting holes.

24. The truck mounted brake assembly of claim 22 further comprising a piston travel indicator associated with said second bracket.

25. The truck mounted brake assembly of claim 17 further comprising said live lever said live lever having a centered pivot point such that said first and second arms of said live lever are of equal length.

26. The truck mounted brake assembly of claim 17 further comprising said live lever having an offset pivot point such that said first and second arms of said live lever are different lengths.

27. The truck mounted brake assembly of claim 17 further comprising said actuating lever having a centered pivot point such that said first and second arms of said actuating lever are of equal length.

28. The truck mounted brake assembly of claim 17 further comprising said actuating lever having an offset pivot point such that said first and second arms of said actuating lever are different lengths.

* * * * *